United States Patent [19]

McFarland

[11] Patent Number: 4,494,379

[45] Date of Patent: Jan. 22, 1985

[54] VAPOR DRIVEN POWER SYSTEM

[76] Inventor: Lorrell C. McFarland, 417 E. 12, Claremore, Okla. 74017

[21] Appl. No.: 487,350

[22] Filed: Apr. 21, 1983

[51] Int. Cl.[3] ..... F01K 25/10

[52] U.S. Cl. ..... 60/671; 60/669

[58] Field of Search ..... 60/651, 671, 669

[56] References Cited

U.S. PATENT DOCUMENTS 3,479,817 11/1969 Minto ..... 60/671

3,990,245 11/1976 Heilemann ..... 60/671

*Primary Examiner*—Allen M. Ostrager

*Attorney, Agent, or Firm*—Robert K. Rhea

[57] ABSTRACT

A vapor driven heat engine utilizing a working medium boiling at less than ambient temperature and atmospheric pressure. A heat source vaporizes the medium in a boiler with the vapor being transferred to an insulated vapor header reciprocating a piston in an insulated cylinder by the operation of a control valve exhausting spent vapor at a lower temperature and pressure to a condenser which in turn transfers condensed vapor to a holding tank periodically discharged into the boiler. Vapor is continuously circulated to and from the boiler through heat coils surrounding the vapor header and cylinder to conserve heat energy and pressure.

3 Claims, 1 Drawing Figure

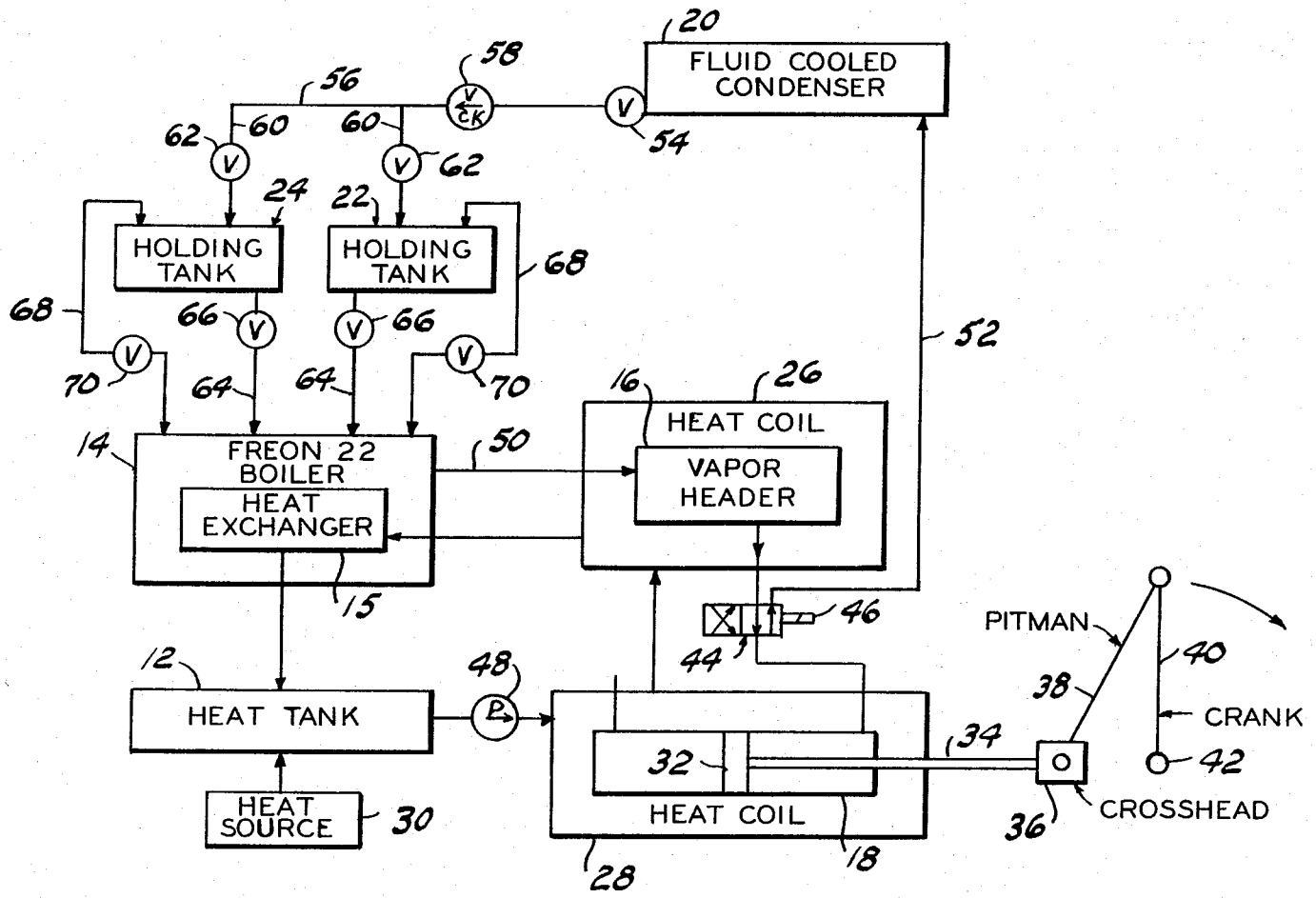
FLUID COOLED CONDENSER
HEAT COIL
VAPOR HEADER
HEAT COIL
HOLDING TANK
HOLDING TANK
FREON 22 BOILER
HEAT EXCHANGER
HEAT TANK
HEAT SOURCE
PITMAN
CRANK
CROSSHEAD
20
54
52
26
16
46
44
18
32
28
34
36
38
40
42
58
56
60
62
68
70
66
64
22
24
50
15
14
48
12
30

VAPOR DRIVEN POWER SYSTEM

BACKGROUND OF THE INVENTION

1. Field of the Invention

The present invention relates to engines and more particularly to a heat engine in which a medium, contained by a closed system, is vaporized for operating the engine and in which the elevated temperature of the vapor is maintained and the medium recycled in a heat energy conserving manner.

2. Description of the Prior Art

Vapor driven engines, such as internal combustion engines, possess several inherent disadvantages, the most significant being inefficient use of nonsynthetic fuel. The fuel consumption of these engines is such that it results in high fuel cost per unit of mechanical work. Other vapor driven engines, such as steam engines, require raising the temperature of water to its boiling point in order to produce engine driving vapor. The energy or BTUs required for conversion of water to steam under suitable working pressure is such that the overall efficiency of the engine is low.

The heat engine of this invention is designed to provide a more cost effective system of producing mechanical or electrical energy which is more efficient than gasoline or internal combustion engines as well as steam engines. Its level of efficiency is less than one-half the cost of internal combustion engines utilizing hydrocarbons as an energy source.

Prior art patents disclose a number of power generating systems utilizing a relatively low boiling temperature working medium in which most or all of the vapor is condensed and returned to the boiler as a liquid after performing work.

These systems do not disclose maintaining the vapor at an elevated temperature and pressure sufficient to retain a major portion of the latent heat energy in the manner accomplished by this invention. Conservation of the heat energy contained by the working fluid of the system is the principal feature of this invention.

SUMMARY OF THE INVENTION

The basic operating principal of the heat engine system is that vapor is produced at a relatively low temperature well below the boiling point of water at sea level. The liquid medium employed is one of a series of nonflammable gaseous and liquid paraffin hydrocarbons that contain one or more fluorine atoms in the molecule, such as the product presently marketed under the trademark Freon 22 having a boiling point much lower than that of water. The Freon 22 medium is contained and recirculated through a closed system. An external heat source vaporizes a medium in a heat tank of selected volume to produce vapor under a desired pressure circulated through a first heat coil surrounding a cylinder containing a piston and a second heat coil surrounding a vapor header where the vapor is transferred to a heat exchanger contained by the boiler and communicating with the heat tank. Freon 22 vapor pressure from the boiler is transferred to the vapor header and through a 4-way valve connected with respective end portions of the cylinder to reciprocate the piston therein and move a load. The 4-way valve transfers the cylinder vapor exhaust to a fluid cooled condenser float controlled to drain into one or more holding tanks in turn emptied into the boiler. All components are insulated against heat loss to conserve the major portion of the vapor heat and back pressure at a temperature higher than the ambient temperature or fluid used for condensing the vapor.

The principal objects of this invention are to provide separate interdependent liquid/vapor closed cycle circulating systems forming a heat engine power source utilizing the vapor of a liquid medium requiring a relatively low temperature for vaporization of the medium in which energy is conserved by maintaining the major portion of the heat of vaporization under sufficient back pressure to be condensed and recirculated in a closed system which will materially reduce the cost of energy employed per unit of mechanical work.

BRIEF DESCRIPTION OF THE DRAWING

The single FIGURE is a mechanical diagram.

DESCRIPTION OF THE PREFERRED EMBODIMENT

Like characters of reference designate like parts in those figures of the drawings in which they occur.

In the drawings:

The reference numeral 10 indicates the heat engine system, as a whole, comprising a heat tank 12, a boiler 14 containing a heat exchanger 15, a vapor header 16, at least one piston equipped cylinder 18, a condenser 20 and holding tanks 22 and 24. Heat coils 26 and 28 respectively surround the vapor header and engine cylinder. The heat tank 12 and boiler 14 contain a liquid medium preferably a nonflammable gaseous or liquid paraffin carbon presently marketed under the trademark Freon 22 having a relatively low boiling point at atmospheric pressure. A heat source 30 heats the Freon 22 in the heat tank 12. The heat source 12 may be a hydrocarbon burner, internal combustion engine exhaust or a solar collector for vaporizing the heat tank contained Freon 22. The engine cylinder 18 contains a piston 32, having a piston rod 34 connected with a cross head 36, having a pitman 38 and a crank 40 angularly rotating a power shaft 42 for driving other equipment, such as an electric generator, not shown.

The vapor header 16 is connected with respective end portions of the cylinder 18 by a hydraulic valve 44 having a solenoid pilot 46 triggered by reciprocating movement of the cross head in a conventional manner. Freon 22 vapor from the heat tank 12 is circulated by a pump 48 through the cylinder heat coil 28 and the vapor header coil 26. The vapor is exhausted from the heat coil 26 to the heat exchanger 15 within the boiler 14 which returns the Freon 22 vapor to the heat tank. Freon 22 vapor in the boiler 14 flows through the line 50 to the vapor header 16 and through the valve 44 to reciprocate the piston 32. Vapor exhausted by the respective ends of the cylinder 18 is transferred from the valve 44 by the line 52 to the condenser 20.

The condenser 20 contains a float, not shown, which operates a dump valve 54 connected with the holding tanks 22 and 24 by a line 56, having a check valve 58, to transfer condensed Freon 22 vapor from the condenser to a selected one of the holding tanks 22 and 24.

Since the holding tanks 22 and 24 are identical, only the holding tank 22 is described in detail. A line 60, having a normally open valve 62 therein, connects the holding tank 22 with line 56. A condensed vapor dump line 64, having a normally closed valve 66, connects the holding tank with the boiler 14. The boiler 14 and holding tank 22 are vented to each other by a line 68 having a normally closed valve 70 therein. A float, not shown, simultaneously closes the valve 62 and opens the valves 66 and 70 to empty the tank 22 into the boiler 14 when the holding tank contains a predetermined quantity of Freon 22.

A prototype of the heat engine was constructed utilizing a 12 inch long cylinder having a 4 inch diameter piston in which initial tests of the engine for energy output and efficiency level reveal it will lift 1250 pounds one foot in one second with the temperature of the Freon 22 at 150° F. (65.56° C.). At this temperature in this test 46 BTU were consumed. The Freon 22 temperature was lowered to 125° F. (51.67° C.) and the engine was able to lift 1034 pounds one foot in one second. The Freon 22 temperature was then raised to 200° F. (93.3° C.) and the engine was able to lift 5026 pounds one foot in one second while consuming 102 BTU.

Comparing the efficiency of Freon 22 to water as a vapor medium Freon 22 boils at −41.46° F. (−40.82° C.) which allows the temperature of the condenser 20 to be relatively low before reaching the boiling point of Freon 22 at sea level. Liquid Freon 22 contains 20 BTU/lb at 35° F. (1.67° C.). Freon 22 vapor at 65° F. (18.33° C.) contains 110 BTU/lb and 2.29 lb/cu ft as compared with 21 lb/cu ft at 200° F. (93.3° C.). The following table further illustrates the efficiency of this medium:

| Medium | Temperature | PSI | BTU/lb |
|---|---|---|---|
| Water | 240.1° F. (115.6° C.) | 10.3 | 998 |
| Freon 22 | 204.8° F. (96° C.) | 707.2 | 91.3 |

As shown by the following table, in comparing an equal volume of Freon 22 vapor versus water vapor the PSI pressure of Freon 22 at 200° F. (93.3° C.) is 8.1 less than the PSI pressure of water at 705.4° F. (374.1° C.). Thus, it requires 8.1 cubic feet of Freon 22 to equal the pressure of one cubic feet of vaporized water but the Freon 22 temperature is 505.4° F. (263° C.) less than the water vapor temperature.

Data used in the following table is based on Thermodynamic Properties of Freon 22 Refrigerant, Table 1, as published by E. I. DuPont De Nemours & Co. (Inc.) Freon Products Division, Wilmington, Del. 19898.

| Freon 22 Vapor Versus Water Vapor | | |
|---|---|---|
| Freon 22 | Water | |
| 125° F. to 200° F. | 212° F. to 705.4° F. | |
| (51.67° C. to 93.3° C.) | (100° C. to 374.1° C.) | |
| Volume cu ft/lb | 0.047 | 0.05 |
| Density lb/cu ft | 21.080 | 20.00 |
| BTU/lb | 55.484 | 722.00 |
| BTU/cu ft | 1169.603 | 14454.00 |
| PSI @ gauge | 394.00 | 3191.50 |
| BTU in 8.1 cu ft Freon 22 | 9473.78 | |
| PSI @ gauge of 8.1 cu ft Freon 22 | 3191.50 | |

Vaporizing a cubic foot of water requires the input of 4980 BTU more than the BTU required to vaporize 8.1 cubic feet of Freon 22.

In initial start-up of the heat engine 10, fluid in the heat tank 12 must be heated by the heat source 30 and the pump 48 operated to circulate the medium through the cylinder and vapor header heat coils 26 and 28 to bring them up to the operating temperature.

In the prototype water was used in the heat tank 30 which was heated to 200° F. (93.3° C.).

Obviously, a rotary vane motor, not shown, may be used in place of the piston equipped cylinder 18 and heat pipe, not shown, used to connect the heat tank 12 to the heat coil 28 and also connect the heat coils to the heat exchanger 15. Output of the heat from the heat source is not wasted in that the heat exchanger 15 transfers this heat to the working medium contained by the boiler 14. When the vapor header and cylinder reach the working temperature, the Freon 22 boiler is also at working temperature so that Freon 22 vapor at 671.66 PSI moves through the line 50 to the vapor header 16 and through the valve 44 to reciprocate the piston. Freon vapor exhausted from the cylinder 18 is maintained at 125° F. (51.67° C.) and 277.92 PSI in the condenser 20 and holding tank 22 or 24. At this condensing temperature and pressure, the Freon 22 liquid retained 47.37 BTU/lb.

The key to the operation of the engine is to establish and maintain the optimum heat differential between the "hot" temperature and the "cool" temperature at optimum operating pressures which vary with the environmental or ambient temperature. Any heat source or cooling can be used that will establish a heat differential with ambient temperature. The ambient temperature has a direct influence upon the most effective "hot" and "cold" temperature and the temperature and pressure ranges in the operation of the engine. The engine offers high fuel efficiency because of relatively low operating temperatures. The engine will operate at the temperature differential between 65° F. (18.33° C.) and 35° F. (1.67° C.) and at those temperatures will save 1223.579 BTU over water and steam doing the same work when water is heated to 705.4° F. (374.1° C.). At any operating temperature the latent heat of condensation is to be higher than the condenser temperature so the latent heat of condensation will flow into the condenser. The condensed vapor is passed to the Freon 22 boiler 14 through one or more of the holding tanks 22 or 24 as explained hereinabove. The condenser 20 may be cooled by a heat pump, not shown, by connecting the cool end of the heat pump with the condenser 20 and the heat pump utilized as the heat source 30 or for heating the boiler 14, thus further conserving heat energy.

Obviously the invention is susceptible to changes or alterations without defeating its practicability. Therefore, I do not wish to be confined to the preferred embodiment shown in the drawings and described herein.

I claim:

1. A self-contained heat energy conserving power system including a boiler containing a working medium boiling at a low temperature relative to water at atmospheric pressure, means for heating the boiler to a vapor producing temperature, a vapor driven engine connected with the boiler and a condenser interposed between the engine exhaust and boiler, the improvement comprising:

a heat exchanger within the boiler;

a first heat coil surrounding the engine and connected with the heat exchanger;

a heat tank connected between the heat exchanger and the first heat coil, said heat tank containing a fluid;

a heat source for heating said heat tank; and, means for circulating hot fluid from said heat tank through said first heat coil and said heat exchanger.

2. The power system according to claim 1 and further including:

a vapor header interposed between the boiler and the engine;

a second heat coil surrounding the vapor header and supplied with hot fluid by said hot fluid circulating means; and, engine control means connecting said vapor header with said engine and said condenser.

3. The power system according to claim 2 and further including:

at least one condensed working medium holding tank interposed between said condenser and said boiler; and, valve and conductor means connecting said holding tank with said condenser and said boiler, respectively.

* * * * *